US008302577B2

(12) United States Patent
Wunsch et al.

(10) Patent No.: US 8,302,577 B2
(45) Date of Patent: Nov. 6, 2012

(54) INTERNAL COMBUSTION ENGINE

(75) Inventors: Thorsten Wunsch, Leonberg (DE); Alexander Kronich, Rutesheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 425 days.

(21) Appl. No.: 12/606,250

(22) Filed: Oct. 27, 2009

(65) Prior Publication Data

US 2010/0132655 A1 Jun. 3, 2010

(30) Foreign Application Priority Data

Nov. 28, 2008 (DE) ..... 10 2008 060 412

(51) Int. Cl.
*F01M 1/02* (2006.01)

(52) U.S. Cl. ..... 123/196 R; 123/195 C; 184/106

(58) Field of Classification Search ..... 123/195 C, 123/196 R, 198 E; 184/106
See application file for complete search history.

(56) References Cited

U.S. PATENT DOCUMENTS

| | | | | |
|---|---|---|---|---|
| 3,515,110 | A | 6/1970 | Deutschmann et al. | |
| 4,773,366 | A | 9/1988 | Seidl et al. | |
| 5,052,354 | A | 10/1991 | Kindaichi | |
| 5,092,291 | A | 3/1992 | Langlois | |
| 5,452,692 | A | 9/1995 | Spray et al. | |
| 5,467,843 | A | 11/1995 | Esch et al. | |
| 6,019,071 | A * | 2/2000 | Maciejka, Jr. | 123/41.35 |
| 7,470,675 | B2 | 12/2008 | Horton et al. | |
| 7,669,576 | B2 * | 3/2010 | Muramatsu | 123/196 R |
| 7,938,095 | B2 * | 5/2011 | Jessberger et al. | 123/195 C |
| 2004/0079318 | A1 | 4/2004 | Batzill | |
| 2007/0272193 | A1 | 11/2007 | Muramatsu | |

FOREIGN PATENT DOCUMENTS

| | | | |
|---|---|---|---|
| DE | 1576361 | | 6/1967 |
| DE | 4001470 | | 1/1990 |
| DE | 4033991 | A1 | 5/1991 |
| DE | 4204522 | C1 | 4/1993 |
| DE | 4139195 | A1 | 6/1993 |
| DE | 19958743 | A1 | 4/2001 |
| DE | 10026113 | A1 | 11/2001 |
| DE | 1002004035329 | A1 | 2/2006 |
| DE | 102005057717 | A1 | 6/2007 |

(Continued)

OTHER PUBLICATIONS

English translation of Chinese Office Action issued in corresponding Chinese Appl. No. 200910164443.3, dated Jun. 2011.

(Continued)

*Primary Examiner* — Noah Kamen
*Assistant Examiner* — Hung Q Nguyen
(74) *Attorney, Agent, or Firm* — RatnerPrestia

(57) ABSTRACT

An internal combustion engine with a crankcase upper part and a crankcase lower part, wherein an oil windage tray is provided, which is flanged onto the crankcase upper part from below, projects into the crankcase lower part, forms a wall for an oil mist roller initiated by the rotation of a crankshaft, and includes at least one carpenter's plane-like slot for separating oil droplets. At least two slots are provided in the rotational direction of the crankshaft and thus in the rotational direction of the oil mist roller, wherein a return opening, through which oil mist-free gases or gases with at least a reduced oil mist content flow back, is provided in the wall of the oil windage tray after each slot, as a result of which friction is reduced.

9 Claims, 5 Drawing Sheets

FOREIGN PATENT DOCUMENTS

| | | | |
|---|---|---|---|
| DE | 102006035888 | A1 | 2/2008 |
| EP | 0515773 | A1 | 12/1992 |
| EP | 0634566 | A1 | 1/1995 |
| EP | 0942155 | A1 | 9/1999 |
| EP | 1482133 | A2 | 12/2004 |

OTHER PUBLICATIONS

German Search Report, Appl. No. 102008060412.7, Dated Apr. 16, 2010.

* cited by examiner

INTERNAL COMBUSTION ENGINE

CROSS REFERENCE TO RELATED APPLICATIONS

This U.S. patent application claims priority to German Application DE 10 2008 060 412.7, filed Nov. 28, 2008, which is incorporated by reference herein in its entirety.

FIELD OF THE INVENTION

The present invention pertains to an internal combustion engine with a crankcase upper part and a crankcase lower part.

BACKGROUND OF THE INVENTION

An internal combustion engine of the type in question is known from DE 42 04 522 C1, which comprises a noise-damping device. The device comprises a shell, which covers the power plant on the side facing the oil pan, at least one opening being provided within this shell to carry lubricating oil away to the oil pan. The opening leads out into a damping chamber, which has at least one drain opening offset from the first opening. In the case of engines with a compensating shaft under the crankshaft, a corresponding type of damping can also be achieved by means of a special design of the shell and of the compensating shaft. A goal of the inventive device is to prevent pulsating noise from acting directly on the oil pan and thus to achieve a low level of sound radiation from the oil pan, especially in the low-frequency range.

EP 0 515 773 B1 describes a device for reinforcing the crankcase of an internal combustion engine. The reinforcing device is provided with openings between the connecting-rod or guide surfaces and thus functions in the manner of an oil windage tray. This oil windage tray is intended to separate oil from gases containing oil mist.

Another internal combustion engine with a shell-like oil deflecting part is known from DE 40 01 470 A1. This part is located in a parting seam of the internal combustion engine extending around an edge of the oil pan. An integrated seal, which is intended to simplify the assembly of the internal combustion engine, is provided on the flange-shaped edge of the oil deflecting part.

Other similar internal combustion engines are known from DE 199 58 743 A1 and from DE 1 576 361.

SUMMARY OF THE INVENTION

The present invention deals with the problem of providing an improved design for an internal combustion engine of the general type in question, namely, a design which comprises in particular a reduced level of frictional losses. The invention relates to the general idea of providing a so-called oil windage tray (which may also be referred to in the art as an air-oil separator tray), which is designed to separate oil from oil mist-containing gases, with a return opening for mist-free gases or for gases with at least a reduced oil mist content, this opening being located at a point located after, with respect to the rotational direction of an oil mist roller, a stripper edge of the oil windage tray. By means of this opening, the ventilation losses of an oil windage tray of this type and thus the frictional losses of the internal combustion engine can be reduced. According to aspects of the invention, the internal combustion engine comprises a crankcase upper part and, attached thereto, a crankcase lower part, wherein, flanged onto the latter from underneath and projecting into the crankcase lower part, an oil windage tray is provided, which forms a wall for an oil mist roller, which is initiated (i.e., actuated) by the rotation of the crankshaft, the windage tray comprising at least two slots (stripper edges) arranged next to each other in the rotational direction of the oil mist roller. Following each of these slots, at least two of which are provided, there is a return opening provided in the wall of the oil windage tray, through which, according to aspects of the invention, the oil mist-free gases or the gases with at least a reduced oil mist content can be returned to a roller space (i.e., the crankshaft space) above the oil windage tray, as a result of which the frictional losses initiated by the oil windage tray can be significantly reduced.

In an advantageous embodiment of the invention, the oil windage tray is made of plastic, especially in the form of an injection-molded plastic part. Injection molding makes it possible to produce plastic parts with extremely accurate shapes and at low unit cost at the same time. In addition, through a suitable choice of plastic, influence can be exerted on the subsequent properties of the plastic, as a result of which these properties can be adapted optimally to the specific purpose. It is highly advantageous, however, that, as a result of the injection-molding process in particular, it is possible to choose practically any imaginable shape, which, if the oil windage tray of this type were to be produced out of metal, could be done only with a great deal more difficulty and thus at much higher cost.

In another advantageous embodiment of the invention, a damping element is attached from below to the oil windage tray. This damping element has the job in particular of defoaming the oil which has collected in the area and which escapes in the downward direction through corresponding openings in the damping element. In addition, the inventive damping element also reduces the gas pressure pulsations acting on the oil level. Of course, the damping element also contributes a strong braking action on the blow-by gases, which are flowing at relatively high velocity, as a result of which the separated oil can pass by the damping element with practically no resistance.

According to another aspect of the invention, the oil windage tray is designed as a component of an oil return device, which is attached to the crankcase lower part and projects into the crankcase upper part. In addition, the oil return device not only returns the oil but also performs other functions as a result of the integration of the oil windage tray and the displacer volumes.

The oil return device is made of plastic, especially in the form of an injection-molded plastic part, and consists essentially of an upper part and a lower part, which are usually injection-molded separately and then welded together. The additional functional elements such as the oil windage tray or the displacer volumes and the damping element are integrated into the lower and upper parts of the oil return device, which means that these functional elements can be produced in a single work step together with the oil return device and can then also be installed in the same assembly step, as a result of which a separate and complicated assembly process for each of the individual functional elements can be eliminated.

The invention therefore offers two essential advantages: First, it makes possible the low-cost production of an oil return device, into which several functional elements are simultaneously integrated, so that there is no longer any need to produce these functional elements separately. Second, as a result of the functional elements now integrated into the one-piece oil return device, the assembly of the internal combustion engine is also simplified, as a result of which shorter assembly times and thus reduced assembly costs can be achieved. In addition, the number of different parts can also be reduced, which leads to a reduction of storage and logistics costs.

In an advantageous elaboration of the invention, the following functional elements are integrated into the upper part of the oil return device: the oil windage tray for separating oil droplets and the displacer volumes, which are at least partially immersed when the oil level falls and which thus raise the oil level and always keep it at an adequate level for supplying oil to the internal combustion engine. According to the present invention, the displacer volumes and the oil windage tray are combined into a single unit. Through the integration of these functional elements into the upper part of the oil return device, this entire complex can be produced at low cost and also installed easily.

In another advantageous embodiment of the invention, the following functional elements are integrated into the lower part of the oil return device: an oil return with two downtubes, which lead downward through the oil guide housing, and the damping element for defoaming and calming the oil which has been separated by the oil windage tray. Thus two additional functional elements are now integral components of the lower part of the oil return device.

It is obvious that the features cited above and to be explained further below can be used not only in the combination indicated but also in other combinations or even alone without abandoning the scope of the present invention.

BRIEF DESCRIPTION OF THE DRAWINGS

Preferred exemplary embodiments of the invention are illustrated in the drawings and are explained in greater detail below, wherein the same or similar or functionally equivalent parts are designated by the same reference numbers.

In schematic fashion.

DETAILED DESCRIPTION OF THE PREFERRED EMBODIMENTS

Figure 1:
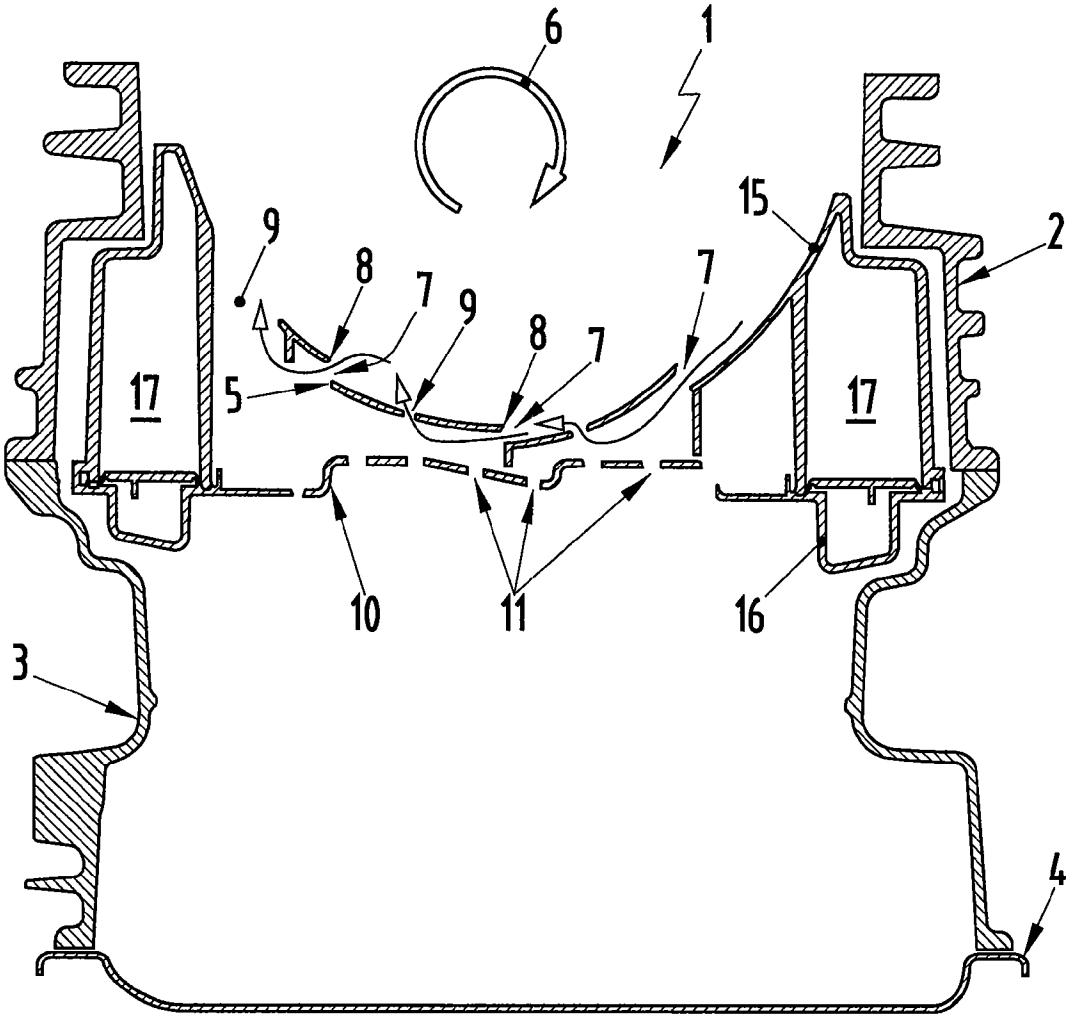
FIG. 1 shows a cross section through an inventive internal combustion engine.

As shown in FIG. 1, an internal combustion engine 1 comprises a crankcase upper part (not shown) and, connected thereto, especially by screws, a crankcase lower part 2, which together from the boundaries of a crankshaft space. Underneath the crankcase lower part 2, furthermore, an oil guide housing 3 with an oil pan 4 at the bottom is provided.

Figure 2:
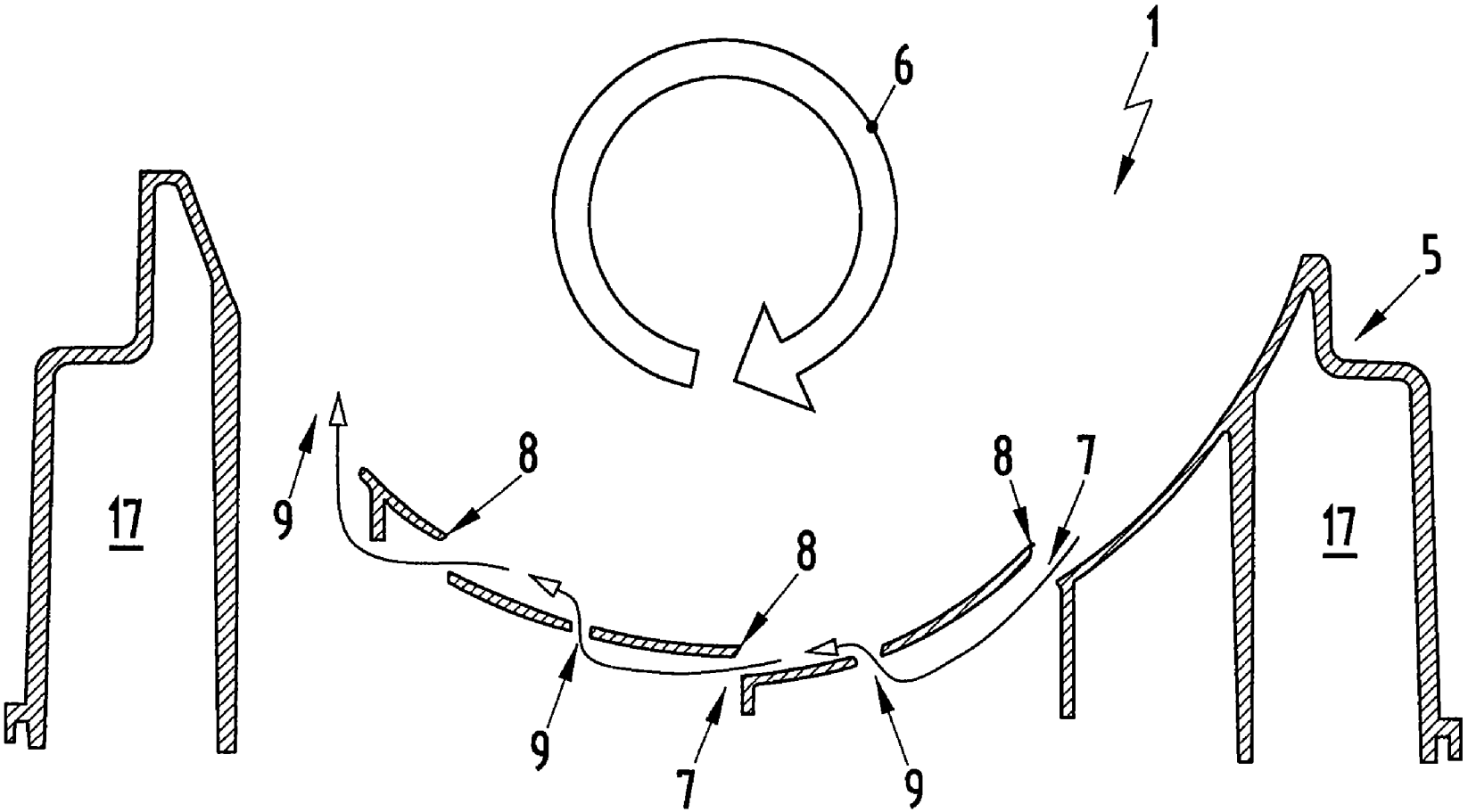
FIG. 2 shows a detailed representation of the cross section according to FIG. 1 in the area of the oil windage tray.

According to aspects of the invention, an oil windage tray 5 is flanged onto the crankcase upper part from underneath. At least part of the tray extends into the crankcase lower part 2. The oil windage tray 5 is designed as a component of an oil return device 14, which is attached to the crankcase lower part 2 and projects into the crankcase lower part 2. The oil windage tray 5 forms a wall for an oil mist roller, initiated by the rotation of the crankshaft, wherein, according to FIGS. 1 and 2, a rotational direction of the crankshaft and thus of the oil mist roller is designated by the reference number 6. As shown in FIGS. 1 and 2, the oil windage tray 5 comprises three slots 7, each of which is bounded on one side by a stripper edge 8 designed in the manner of a carpenter's plane. To minimize the frictional losses during the rotational movement of the crankshaft, an associated return opening 9 is provided in the wall of the oil windage tray 5 after each slot 7, i.e., after with respect to the rotational direction 6 of the oil mist roller. Through these return openings 9, it is possible for the oil mist-free gas or the gas with at least a reduced oil mist content to flow back into the area of the crankshaft space.

The inventively designed oil windage tray 5 and especially its inventive oil windage geometry have the effect of stripping away the oil entrained by the rotating crankshaft and/or the connecting rods moving along with it, wherein the geometry of the stripper edges 8 is such that, in alternation, the air-oil mixture can be stripped off and the gas, now with a reduced oil mist content, can be returned through the following return opening 9. As a result, ventilation losses in particular and thus frictional losses during the operation of the internal combustion engine 1 can be minimized.

The oil windage tray 5 can, of course, also be made of plastic, especially in the form of a so-called injection-molded part, as a result of which even difficult geometries can be realized easily and at low cost, especially at low unit cost.

As can also be derived from FIG. 1, a damping element 10 is attached from underneath to the oil windage tray 5. This damping element can be designed in particular as a perforated sheet metal damping plate. It is also conceivable, of course, that the damping element 10 could be made alternatively of plastic. The damping element 10 comprises several, especially a plurality, of through-openings 11, through which the oil separated by the oil windage tray 5 can be returned to the oil pan 4. The damping element 10 takes care of defoaming the oil which has collected in this area and reduces in particular the gas pressure pulsations acting on the oil level. The damping element 10 also sharply brakes the blow-by gas, so that the separated oil can flow off with practically no resistance through the through-openings 11 in the damping element and down into the oil pan 4.

Figure 3:
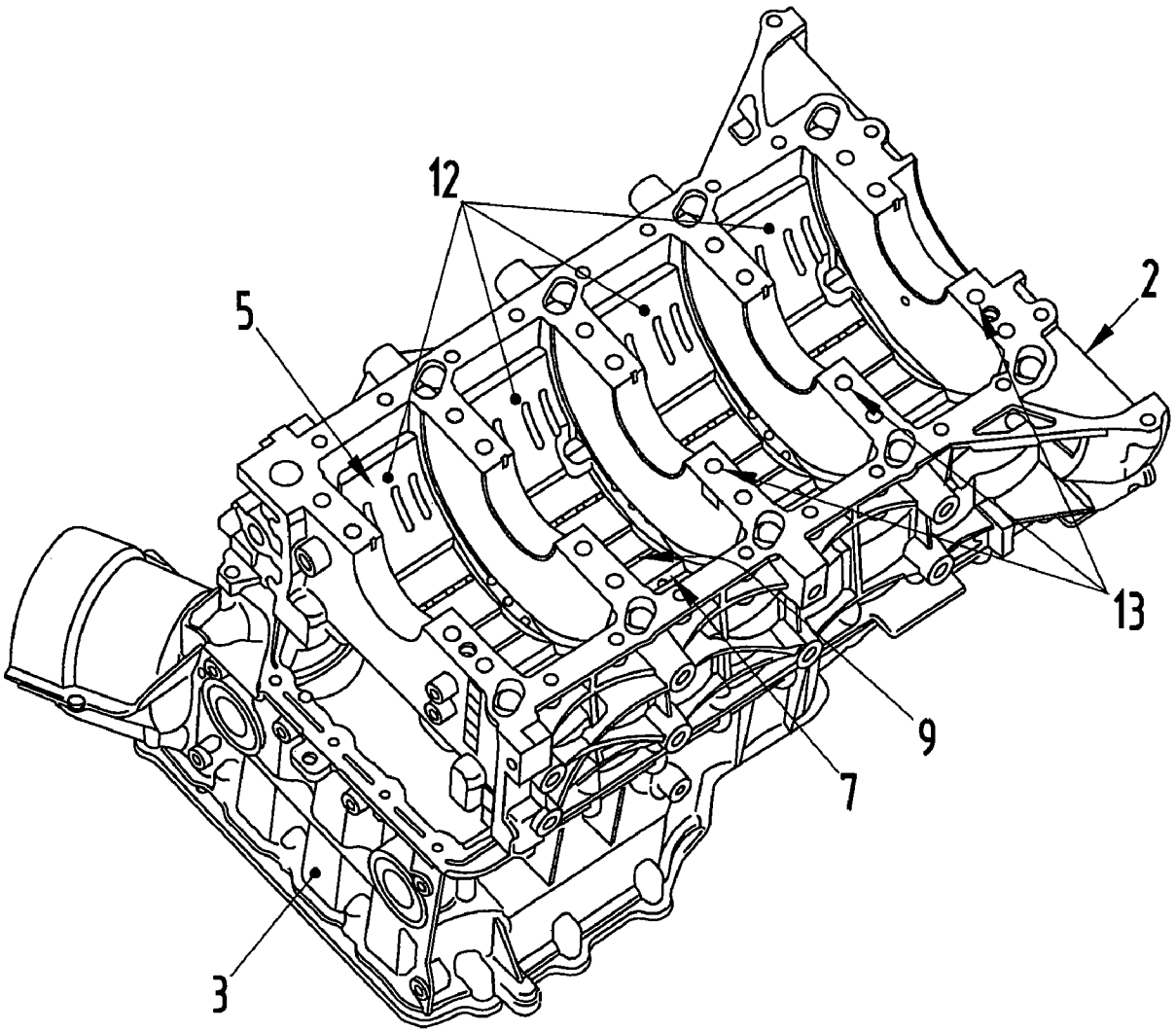
FIG. 3 shows a crankcase lower part with installed oil windage tray and attached oil guide housing.
Figure 4:
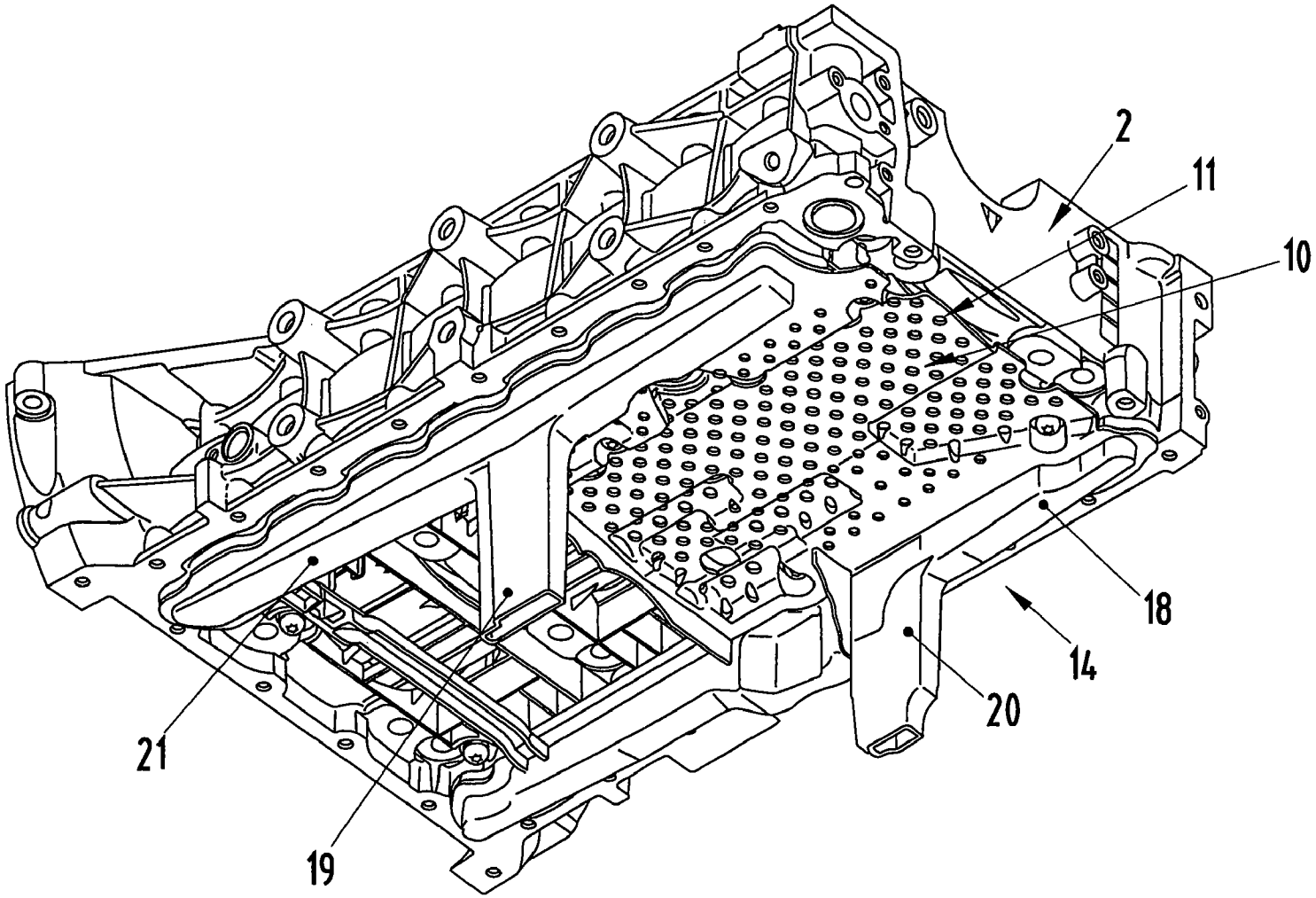
FIG. 4 shows an oil return device attached to the crankcase lower part.

When we consider FIG. 3, we can see that the oil windage tray 5 comprises several segments 12, which are arranged a certain distance apart in the axial direction (of the crankshaft), wherein an axial spacing is selected so that the individual segments 12 project upward between support blocks 13 of the crankcase lower part 2.

The inventively designed oil windage tray 5, as is especially clear from FIG. 2, makes it possible to return oil mist-free gases, or gases with at least a reduced oil mist content, to the crankshaft space, as a result of which the friction of the rotating crankshaft can be significantly reduced and thus the efficiency of the internal combustion engine 1 increased.

Figure 5:
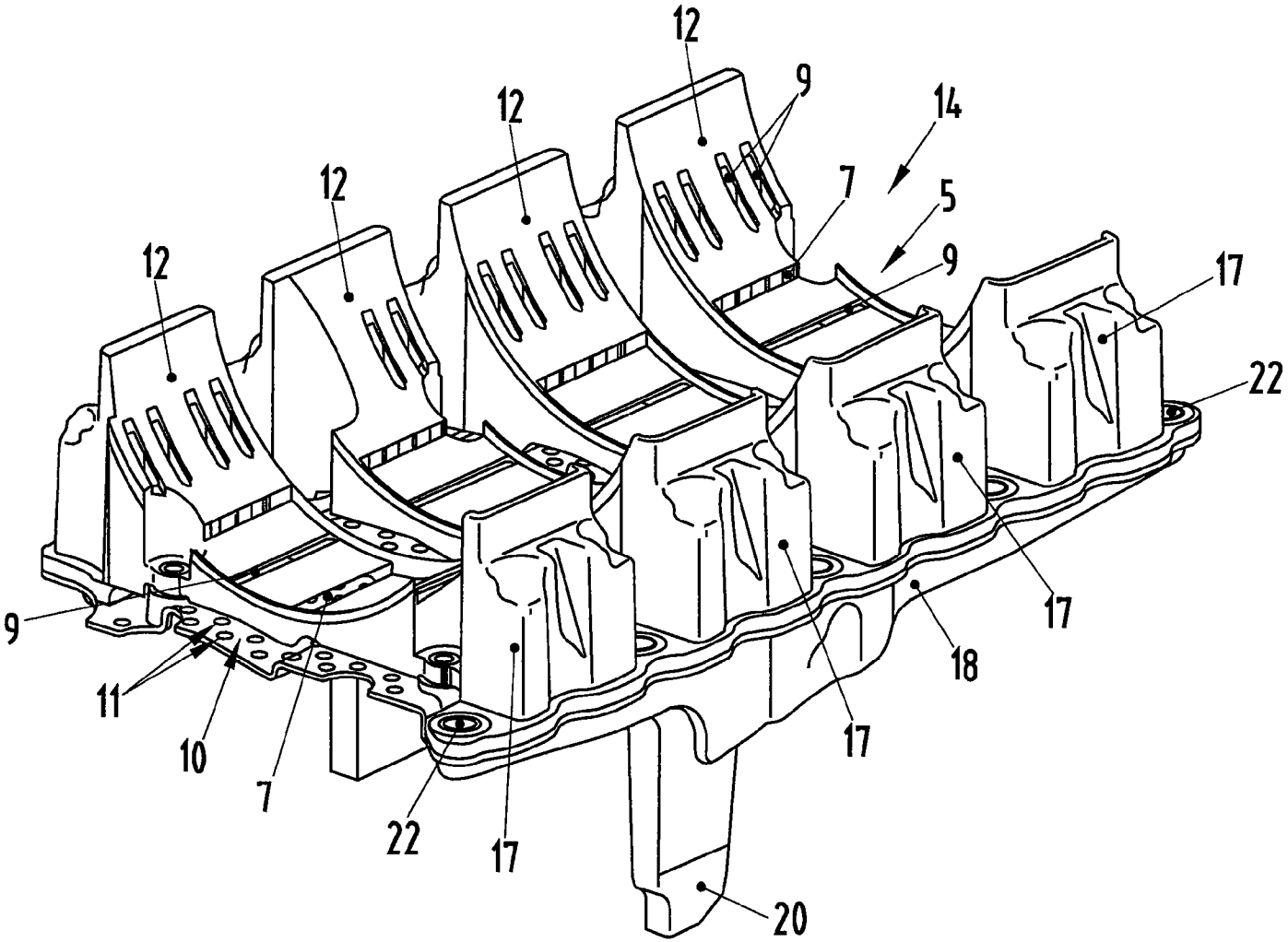
FIG. 5 shows a perspective view of the oil return device.

The oil return device 14, according to FIGS. 1 and 5, comprises an upper part 15 and, connected thereto, especially welded thereto, a lower part 16. The oil windage tray 5, the damping element 10, the displacer volumes 17, and an oil return 18, 21 with associated down-tubes 19, 20 are integrated into the oil return device 14. The oil return device 14 is made of plastic, especially in the form of an injection-molded part. The two separately produced parts, namely, the upper part 15 and the lower part 16, of the oil return device 14 are then welded together in a subsequent assembly step and thus connected to each other preferably in a leak-tight manner. According to aspects of the invention, the oil return device 14 is attached from underneath to the crankcase lower part 2 and projects downward into the oil guide housing 3 and into the oil pan 4. According to aspects of the invention, at least part of the upper part 15 projects into the crankcase lower part 2.

The oil windage tray 5 and the displacer volumes 17 are designed as integral parts of the upper part 15 of the oil return device 14. The displacer volumes 17 are intended to be at least partially immersed when the internal combustion engine tilts and thus the oil level tilts, as a result of which they raise the overall oil level, so that, even during critical driving situations, such as extreme transverse accelerations of the vehicle, it can be guaranteed that there will always be an adequate oil level, that is, that the level will always be high enough to supply the internal combustion engine with the necessary oil. The displacer volumes 17, like the oil windage tray 5, are designed as integral parts of the upper part 15 of the oil return device 14 and thus can be produced together with that device in a single work step and can in particular be installed in the crankcase of the internal combustion engine in the same assembly step.

In contrast, the oil return 18, 21 with the two down tubes 19, 20, which pass downward through the oil guide housing 3 and preferably into the oil pan 4, and the damping element 10 for defoaming and calming the oil separated by the oil windage tray 5 from the oil mist roller, are integrated into the lower part 16 of the oil return device 14. As can also be derived in particular from FIG. 5, the oil return device 14 comprises lateral oil return openings 22, through which oil flowing back from a cylinder head can be supplied to the oil return 18 or 21 and thus via the down tubes 19 and 20 to the oil guide housing 3, i.e., to the oil pan 4.

The invention claimed is:

1. An internal combustion engine comprising an crankcase upper part, a crankcase lower part, and an oil windage tray flanged onto the crankcase upper part from below, wherein the oil windage tray projects into the crankcase lower part, forms a wall for an oil mist roller that is actuated by rotation of a crankshaft, and comprises at least one carpenter's plane-like slot for separating oil droplets, wherein at least two slots are provided in a rotational direction of the crankshaft and in a rotational direction of the oil mist roller, wherein a return opening, through which oil mist-free gases or gases with at least a reduced oil mist content flow back, is provided in the wall of the oil windage tray after each slot, wherein the oil windage tray is arranged between displacer volumes, and the oil windage tray and the displacer volumes are configured as integral parts of an upper part of an oil return device, wherein the displacer volumes are positioned to maintain an adequate oil level thereby ensuring that the internal combustion engine is supplied with oil.

2. An internal combustion engine according to claim 1, wherein the oil windage tray is attached to the crankcase lower part.

3. An internal combustion engine according to claim 1, wherein the oil windage tray is composed of plastic.

4. An internal combustion engine according to claim 1, wherein the oil windage tray comprises several segments, which are arranged a pre-determined distance apart in an axial direction, wherein an axial spacing is selected such that individual segments project in an upward direction between support blocks of the crankcase lower part.

5. An internal combustion engine according to claim 1, wherein an oil guide housing with an oil pan at a bottom end of the oil guide housing is flanged to the crankcase lower part from below.

6. An internal combustion engine according to claim 1, wherein a damping element is connected to the oil windage tray from below.

7. An internal combustion engine according to claim 6, wherein the damping element is a perforated sheet metal damping plate.

8. An internal combustion engine according to claim 6, wherein the damping element is composed of plastic.

9. An internal combustion engine according to claim 1, wherein the oil windage tray has a semicircular cross section.

* * * * *